United States Patent [19]

Oguma et al.

[11] Patent Number: 4,530,339

[45] Date of Patent: Jul. 23, 1985

[54] SUPERCHARGER CONTROL APPARATUS FOR MOTOR VEHICLES

[75] Inventors: Tomio Oguma, Anjo; Seiji Hayakawa, Nagoya, both of Japan

[73] Assignee: Aisin Seiki Kabushiki Kaisha, Japan

[21] Appl. No.: 480,351

[22] Filed: Mar. 30, 1983

[30] Foreign Application Priority Data

Mar. 31, 1982 [JP] Japan ..... 57-52920

[51] Int. Cl.[3] ..... F02D 23/00

[52] U.S. Cl. ..... 123/561; 123/564

[58] Field of Search ..... 60/600, 601, 602, 603, 60/611; 123/559, 561, 564

[56] References Cited

U.S. PATENT DOCUMENTS 1,955,799 4/1934 Fielden ..... 123/564

FOREIGN PATENT DOCUMENTS 903517 2/1954 Fed. Rep. of Germany ..... 123/561
137323 11/1978 Japan ..... 60/611
84818 6/1980 Japan ..... 60/602
52621 3/1982 Japan ..... 60/611

OTHER PUBLICATIONS

Buike et al., "Supercharging for Fuel Economy", Paper No. 810006, Bendix Supercharger Engineering Center, Farmington, MI, Copyright 1981, by Society of Automotive Engineers, Inc.

*Primary Examiner*—Michael Koczo
*Attorney, Agent, or Firm*—Finnegan, Henderson, Farabow, Garrett & Dunner

[57] ABSTRACT

Supercharger control apparatus for the internal combustion engine of a motor vehicle comprises a control device which has as input signals the demand signal for acceleration (such as a signal based on the amount of throttle valve opening) and an engine rotational speed signal. Based on predetermined ranges of demand signal for acceleration and engine rotational speed and on the input signals, the control device regulates, through an actuator and bypass valve or through an actuator and variable capacity compressor, the amount of supercharging. The supercharge control apparatus allows a non-supercharged state, a maximum supercharged state, or an intermediate supercharged state. In the intermediate supercharged state, the amount of supercharging is in incremental steps to prevent hunting.

5 Claims, 6 Drawing Figures

SUPERCHARGER CONTROL APPARATUS FOR MOTOR VEHICLES

BACKGROUND OF THE INVENTION

1. Field of the Invention

This invention relates generally to control apparatus for motor vehicles and, more particularly, to improved supercharger control apparatus for use in conjunction with an internal combustion engine of a motor vehicle.

2. Description of the Prior Art

A supercharger can be driven by the output torque of an internal combustion engine to supercharge the air flow being routed into the intake manifold of the engine. The operation of such a supercharger is effective in increasing the output torque of the engine thereby satisfying acceleration requirements when demanded; however, the operation also causes increased fuel consumption under normal driving conditions of the motor vehicle.

One conventional supercharger system for motor vehicles utilizes a control device which controls the activation and deactivation of the supercharger in accordance with demand signals for vehicle acceleration. The demand signals are a function of the relation between an acceleration signal (such as the amount of throttle valve opening) and the rotational speed of the engine. This two-staged, on-off controlling of the supercharger has a major drawback, however, since supercharged conditions of the engine cannot be appropriately tailored to the various particular driving states of the vehicle. Additionally, the control system has hunting problems. Furthermore, the use of such systems has an adverse effect on fuel consumption efficiency.

An object of the present invention is, therefore, to provide improved supercharger control apparatus which overcomes the aforementioned disadvantages of the conventional supercharger control system.

SUMMARY OF THE INVENTION

To achieve the foregoing objects and in accordance with the purposes of the invention, as embodied and broadly described herein, in a motor vehicle's internal combustion engine having an air duct to provide air to an intake manifold of the engine, a supercharger control apparatus comprises a compressor for providing supercharged air flow into the intake manifold of the engine and means for controlling the amount of air flow into the engine manifold in accordance with the driving states of the motor vehicle as determined by the demand signal for acceleration and the rotational speed of the engine wherein the controlling means provides, at predetermined ranges of demand signal and rotational speed, non-supercharging, intermediate supercharging, or maximum supercharging. In a preferred embodiment, the controlling means includes a control device having a transforming circuit and an actuator wherein the circuit provides control signals to the actuator for non-supercharging, intermediate supercharging, or maximum supercharging based on the demand signal for acceleration and the rotational speed of the engine and the actuator responds to the signal to regulate the amount of supercharged airflow into the engine manifold. Preferably, an air duct to bypass the compressor is utilized with a bypass valve in the bypass duct wherein the actuator controls the operation of the bypass valve to regulate the amount of supercharged airflow into the engine manifold.

BRIEF DESCRIPTION OF THE DRAWINGS

Various other features, objects, and attendant advantages of the invention will become apparent hereinafter when considered in conjunction with the accompanying drawings and detailed description of the invention.

Of the drawings, which are incorporated in and constitute a part of this specification.

DESCRIPTION OF THE PREFERRED EMBODIMENT

Figure 1:
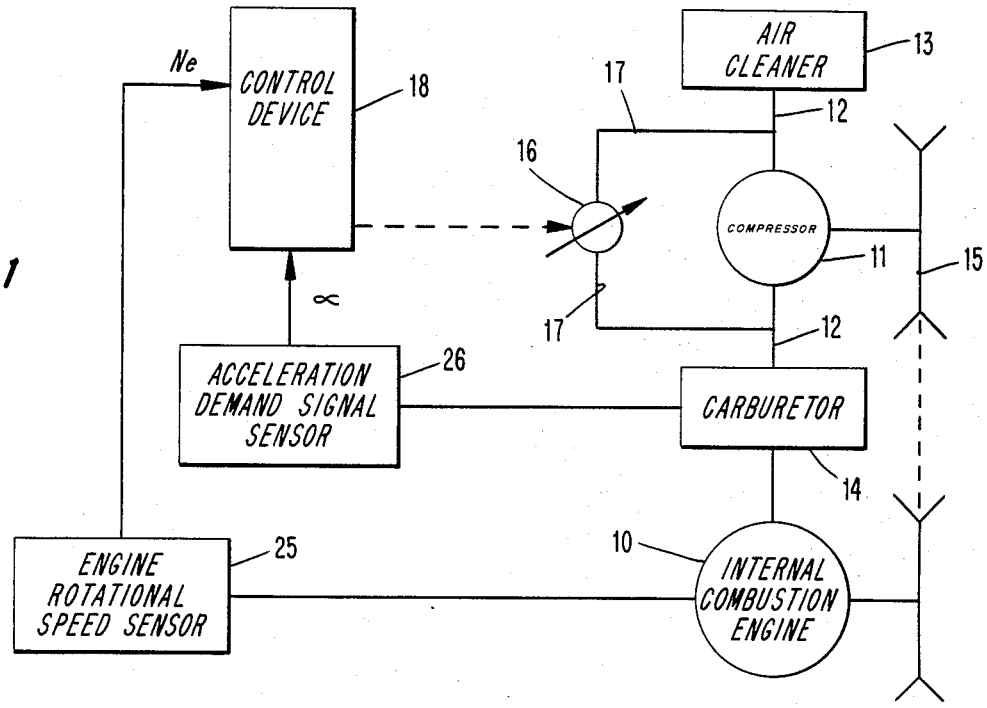
FIG. 1 is a schematic block diagram of a preferred embodiment of a supercharger control apparatus for motor vehicles according to the present invention.

Referring now to the drawings, particularly to FIG. 1, there is illustrated a preferred embodiment of the invention in which the supercharger control apparatus is adapted to an internal combustion engine 10 which has an air cleaner 13 connected to a carburetor 14 and thus to the intake manifold of the engine by means of an air duct 12. As shown in FIG. 1, the compressor 11 of the supercharger is connected in line with air duct 12. Compressor 11 is arranged so that it is driven by the output torque of engine 10 through a transfer member 15, such as a pulley-belt arrangement or gears, to supercharge engine 10.

The supercharger control apparatus of the invention includes means for controlling the amount of air flow into the engine manifold as determined by the demand signal for acceleration and the rotational speed of the engine, wherein the control means provides, at predetermined ranges of demand signal and rotational speed, non-supercharging, intermediate supercharging, or maximum supercharging, as described more fully below. As embodied herein and as shown in FIGS. 1 and 3, the controlling means includes a control device 18 with transforming circuit 19 and actuator 20, bypass airduct 17, and bypass valve 16 which is controlled by actuator 20.

Bypass valve 16 is connected in line with bypass duct 17 for allowing air flow to bypass compressor 11 of the supercharger thereby allowing the control of the amount of air flow within air duct 12 thus controlling the amount of supercharged air flow which is received by the intake manifold of engine 10.

The amount of opening and closing of bypass valve 16 is controlled by the output of control device 18. The output of control device 18 is derived from a signal dependent upon the relation between the rotational speed of engine 10 as sensed by engine rotational speed sensor 25, and the demand signal for acceleration of the motor vehicle, such as the amount of throttle valve opening as sensed by acceleration demand signal sensor 26, to control the supercharged air flow into engine 10.

Figure 3:
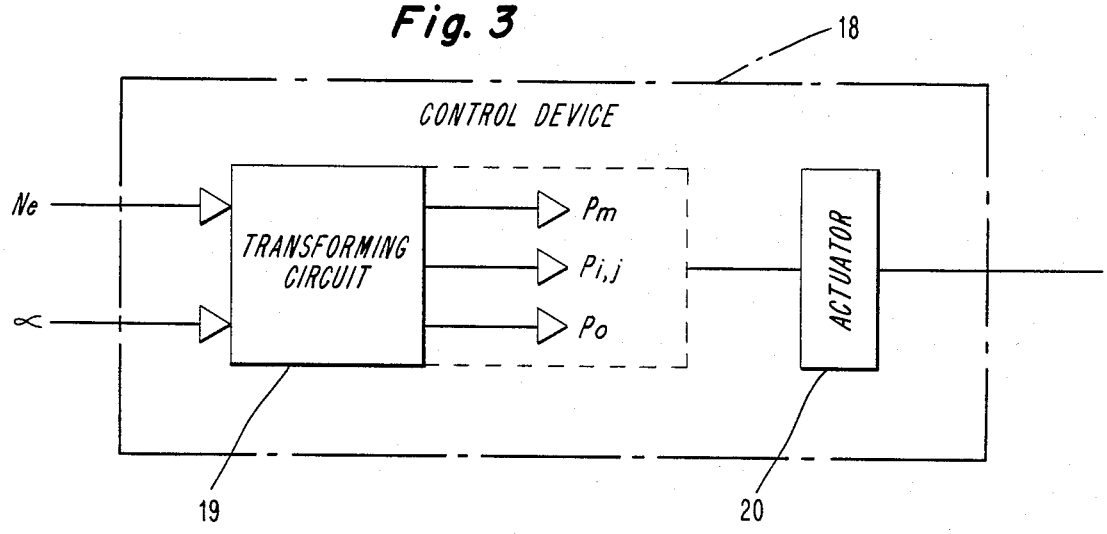
FIG. 3 is a schematic block diagram of the control device according to the invention.

In FIG. 3, control device 18 is shown having a transforming circuit 19 and an actuator 20. Actuator 20 is controlled by one of three indicating signals —$P_m$, $P_{ij}$, $P_o$— supplied from transforming circuit 19. The output of actuator 20 controls the operation of bypass valve 16 in the preferred embodiment of FIG. 1.

Figure 2:
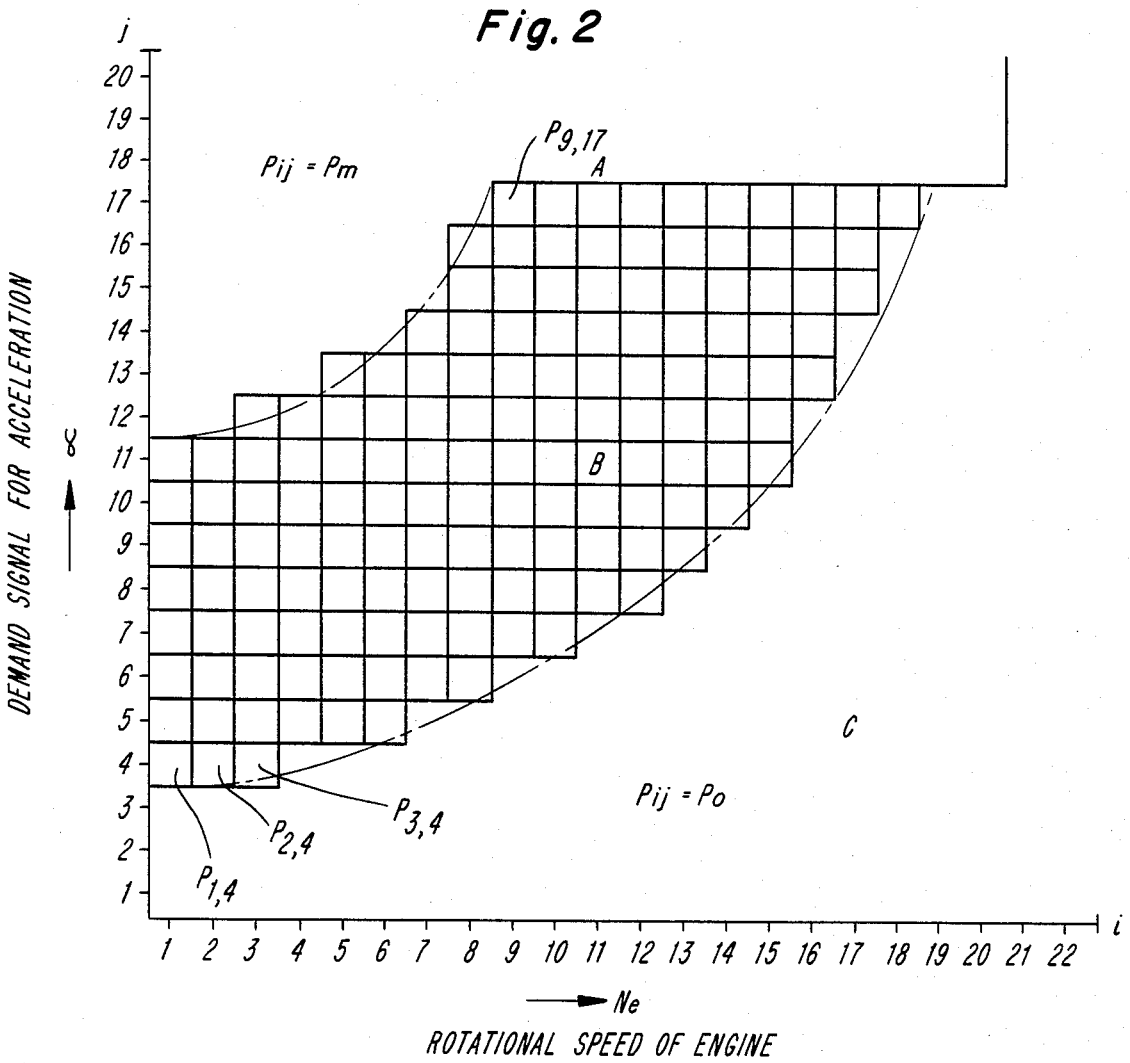
FIG. 2 is a graph illustrating supercharged conditions in accordance with a predetermined relationship between the rotational speed of an engine and the demand signal for acceleration (such as the amount of throttle valve opening or the amount of fuel demand) according to the invention.

The indicating signals given from transforming circuit 19 are determined by the two-dimensional standard coordinate ($P_{ij}$) for supercharging as shown in FIG. 2, wherein the abscissa (i) is the rotational speed $N_e$ of engine 10, and the ordinate (j) is demand signal $\alpha$ for acceleration of the motor vehicle. Then, the two-dimensional standard coordinate is divided into three ranges designated A, B, and C, as shown in FIG. 2. In the present invention, range A is the maximum supercharged range, range B is the intermediate supercharged range, and range C is the non-supercharged range.

Transforming circuit 19 supplies indicating signal $P_m$ indicating the maximum supercharged range to actuator 20 when the rotational speed ($N_e$) of engine 10 from rotational speed sensor 25 and the demand signal for acceleration ($\alpha$) from acceleration demand signal sensor 26 are such that coordinate ($P_{ij}$) is located in range A. Similarly, transforming circuit 19 supplies indicating signal $P_o$ indicating the non-supercharged range to actuator 20 when the coordinate ($P_{ij}$) is located in range C. Thus, flow within air duct 17 in the preferred embodiment illustrated in FIG. 1 is controlled for the maximum supercharged state and for the non-supercharged state by the operation of bypass valve 16 in accordance with the operation of actuator 20 as it responds to indicating signals $P_m$ and $P_o$. As a result, the air flow into the intake manifold of engine 10 via air duct 12 is appropriately regulated in accordance with the driving states of the motor vehicle.

Transforming circuit 19 supplies indicating signal $P_{ij}$ indicating an intermediate supercharged range to actuator 20 when the coordinate ($P_{ij}$) is located in range B. Actuator 20 receives indicating signal $P_{ij}$ and controls the opening of bypass valve 16 in response to that indicating signal $P_{ij}$ in order to provide the intake manifold of engine 10 with the appropriate supercharged air via air ducts 12 and 17.

In the preferred embodiment, the amount of supercharging is allowed to change only in steps for the intermediate supercharged range. As shown in FIG. 2, range B can be subdivided into incremental cells (e.g., P1,4; P2,4; P9,17) as an aid in prohibiting the apparatus from hunting. More particularly, the magnitude of the intermediate indicating signal $P_{ij}$ can be made in incremental steps in response to the position of a cell in which the coordinate ($P_{ij}$) is positioned. Thus, for each combination of demand signal $\alpha$ and engine rotational speed $N_e$ (i.e., for each coordinate ($P_{ij}$)) within a particular cell, a single intermediate indicating signal $P_{ij}$ is created and transferred to actuator 20 from transforming circuit 19 of control device 18.

The cells nearer range C indicate smaller supercharged air flow comparatively, and the cells nearer range A indicate supercharged air flow which is closer to the maximum supercharged airflow (which occurs when a coordinate falls within range A and the indicating signal becomes $P_m$).

As shown in FIG. 2, range B is defined by one broad line corresponding to the rotational speed of the engine when the demand signal for acceleration is large, another broad line corresponding to the demand signal for acceleration of the vehicle when the rotational speed of the engine is small, and a line connecting the two broad lines.

Arrangement of such a wide range B is effective in order to achieve the supercharged conditions in response to various driving states of the motor vehicle. Namely, the non-supercharged condition is achieved (range C where $P_{ij}=P_o$) when the demand signal for acceleration is decreased or the rotational speed of the engine is increased. Additionally, the supercharged air flow is increased as the rotational speed of the engine decreases and a demand signal for acceleration increases.

Furthermore, the maximum supercharge condition can be reached in spite of the rotational speed of the engine when the demand signal for acceleration exceeds the predetermined values indicated in FIG. 2. And finally, the supercharged air flow is decreased when the rotational speed of the engine increases and the demand signal for acceleration decreases.

Figure 4:
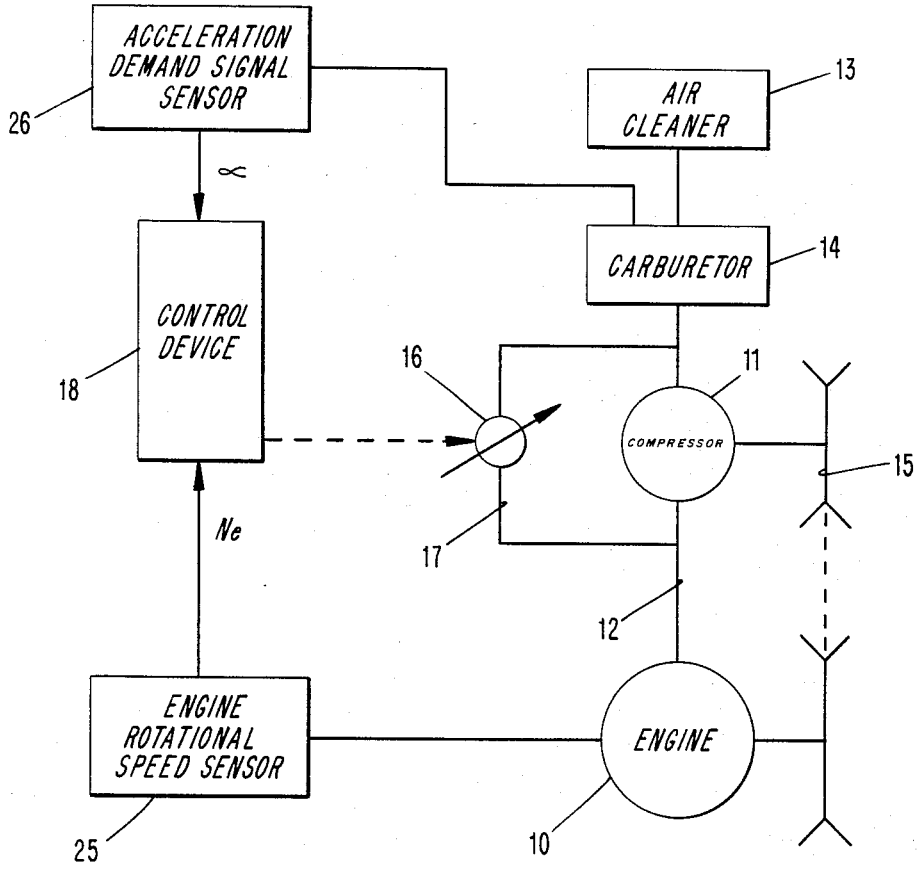
FIG. 4 is a schematic block diagram of a second embodiment of a supercharger control apparatus for motor vehicles according to the invention.

As shown in FIG. 4, compressor 11 of the supercharger and bypass duct 17 with bypass valve 16 and control device 18 can be disposed between carburetor 14 and the intake manifold of engine 10.

Figure 5:
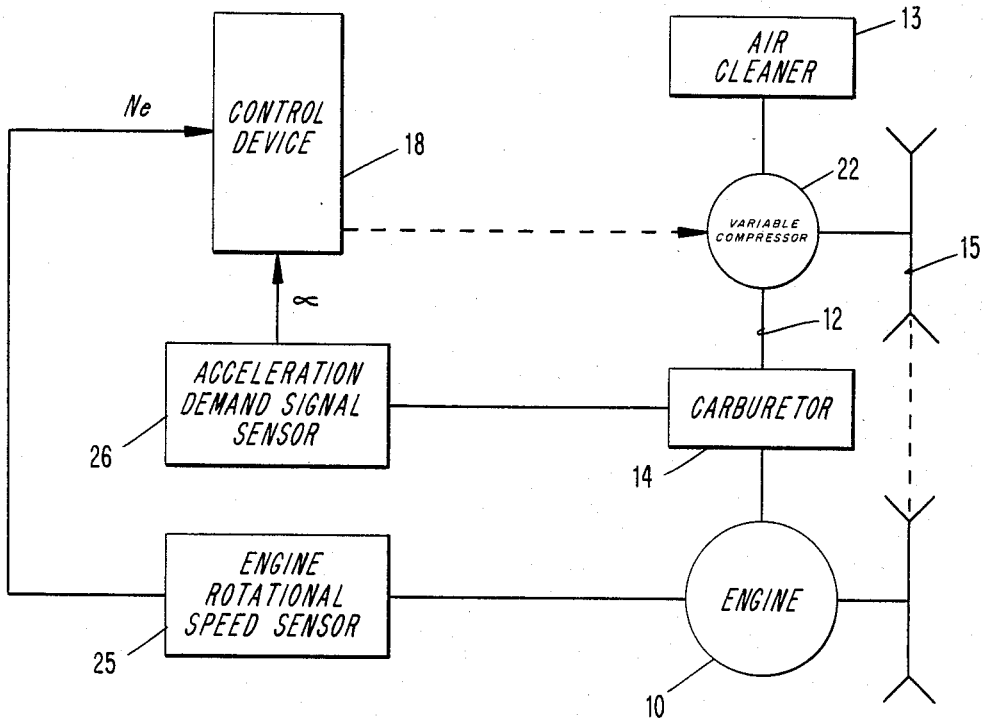
FIG. 5 is a schematic block diagram of a third embodiment of a supercharger control apparatus for motor vehicles according to the invention.

In another embodiment of the invention, as shown in FIG. 5, a variable capacity type compressor 22 is used in place of the compressor-bypass arrangement shown in FIGS. 1 and 4. The capacity of compressor 22 is controlled in response to the output of control device 18 whereby the supercharged air flow into the engine is controlled for non-supercharging, intermediate supercharging, or maximum supercharging.

Figure 6:
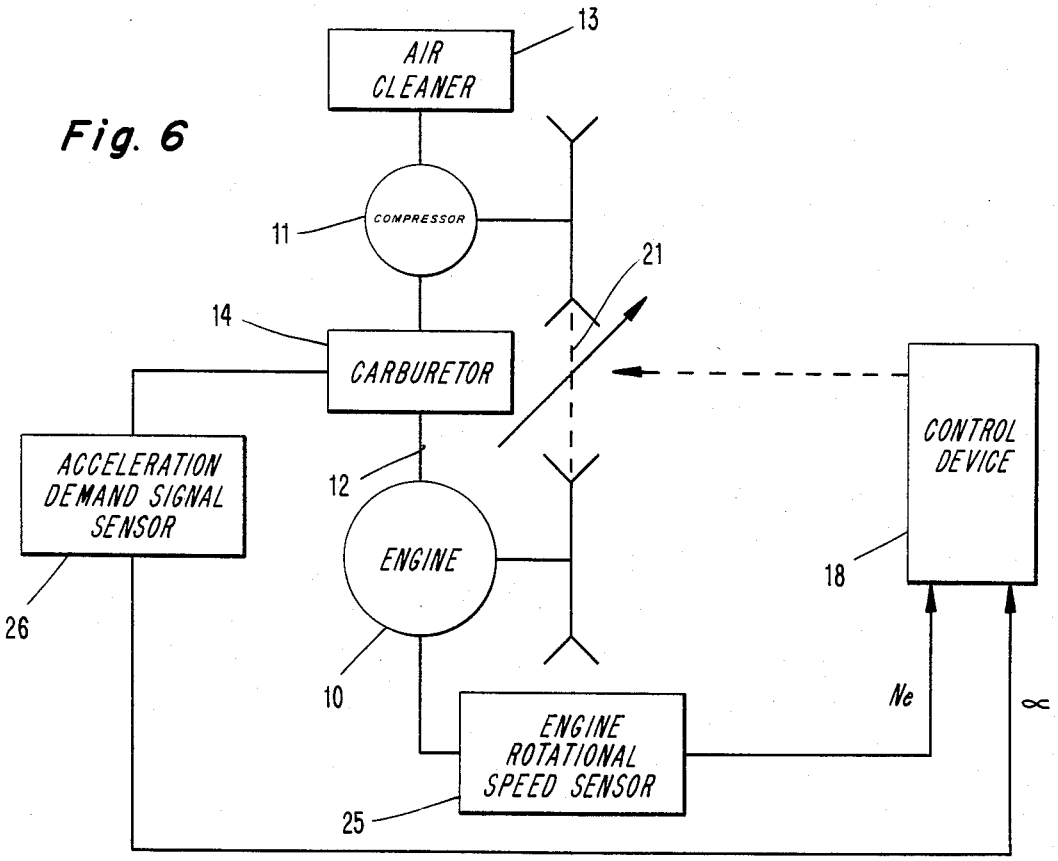
FIG. 6 is a schematic block diagram of a fourth embodiment of a supercharger control apparatus for motor vehicles according to the present invention.

In still another embodiment of the invention, as shown in FIG. 6, the supercharger is driven by output torque of engine 10 which is transmitted to compressor 11 by a variable transmitting mechanism 21. Variable transmitting mechanism 21 is located between engine 10 and compressor 11 and is controlled by the output of control device 18 in order to allow controlled variation in the rotational speed of compressor 11. By varying the rotational speed of compressor 11, the supercharged air flow into the engine can be controlled for non-supercharging, maximum supercharging, or stepped intermediate supercharging.

By the foregoing, there is disclosed a preferred embodiment of the supercharger control apparatus constructed in accordance with the present invention. It will be appreciated that various additions, substitutions, modifications, and omissions may be made thereto without departing from the spirit of the invention and that, within the scope of the appended claims, the invention may be practiced otherwise than as specifically described.

What is claimed is:

1. In a motor vehicle's internal combustion engine having an air duct to provide air to an intake manifold of said engine, a supercharger control apparatus comprising:

a compressor driven by the output torque of said engine for providing supercharged air flow into the intake manifold of said engine;

means associated with said engine for sensing the rotational speed of said engine and for producing a first signal representing said rotational speed;

means associated with said engine for sensing the demand for vehicle acceleration and for producing a second signal representing said acceleration demand; and means associated with said intake manifold for controlling the amount of said air flow into said manifold to regulate the supercharging of said engine in accordance with the driving states of the motor vehicle as determined by said first and second signals, wherein the control means provides, at predetermined ranges of said signals, non-supercharging, intermediate supercharging the degree of which changes in incremental steps to prohibit hunting, or maximum supercharging.

2. The supercharger control apparatus of claim 1, wherein said control means includes a control device having means for transforming said first and second signals into control signals and an actuator wherein said transforming means provides said control signals to said actuator for non-supercharging, intermediate supercharging, or maximum supercharging based on said first and second signals and said actuator responds to said control signals to regulate the amount of supercharged air flow into said engine manifold.

3. The supercharger control apparatus of claim 2, wherein said control means has an air duct to bypass said compressor and a bypass valve in said bypass duct wherein said actuator controls the operation of said bypass valve to regulate the amount of supercharged air flow into said engine manifold.

4. The supercharger control apparatus of claim 2, wherein said compressor is a variable capacity compressor and said actuator varies the output of said variable capacity compressor to regulate the amount of supercharged air flow into said engine manifold.

5. The supercharger control apparatus of claim 2, wherein said compressor is powered by the output torque of said engine and said supercharger control apparatus further comprises a variable transfer mechanism to vary the amount of output torque of said engine to said compressor, wherein said actuator varies the operation of said variable transfer mechanism to control the amount of rotation to said compressor thereby regulating the amount of supercharged air flow into said engine.

* * * * *